US005967130A

United States Patent [19]

Sugauchi

[11] Patent Number: 5,967,130

[45] **Date of Patent: *Oct. 19, 1999**

[54] LIGHT AND DURABLE BOW HAVING BOW HANDLE PRODUCED FROM FORGED ALUMINUM AND PROCESS OF PRODUCING THE BOW HANDLE

[75] Inventor: Akira Sugauchi, Shizuoka, Japan

[73] Assignee: Yamaha Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/850,199

[22] Filed: May 2, 1997

[30] Foreign Application Priority Data

Jul. 9, 1996 [JP] Japan ..... 8-179317
Jul. 9, 1996 [JP] Japan ..... 8-179320

[51] Int. Cl.[6] ..... F41B 5/00

[52] U.S. Cl. ..... 124/23.1; 124/86

[58] Field of Search ..... 148/690, 693, 148/694, 697, 701; 29/417, 557, 897; 124/23.1, 25.6, 86, 88

[56] References Cited

U.S. PATENT DOCUMENTS

| | | | |
|---|---|---|---|
| 3,415,240 | 12/1968 | Bear | 124/23.1 |
| 3,988,180 | 10/1976 | Bouvaist | 148/701 |
| 4,091,790 | 5/1978 | Hoyt | 124/88 X |
| 4,579,604 | 4/1986 | Beyer | 148/693 |
| 4,674,468 | 6/1987 | Izuta | 124/23.1 |
| 5,335,645 | 8/1994 | Simonds et al. | 124/88 |
| 5,365,650 | 11/1994 | Smith et al. | 29/417 |
| 5,507,270 | 4/1996 | Smith | 124/23.1 |
| 5,592,929 | 1/1997 | Hoyt | 124/23.1 |

OTHER PUBLICATIONS

"Tool News: Yamaha Super Feel Forged", Archery magazine, May 10, 1996, pp. 68–69, with partial translation.

"Super Feel Forged", Catalog published by Yamaha Corporation, Jun. 1996.

*Primary Examiner*—John A. Ricci
*Attorney, Agent, or Firm*—Ostrolenk, Faber, Gerb & Soffen, LLP

[57] ABSTRACT

A take-down type bow has a bow handle formed of forged aluminum alloy, and vibration attenuators are provided between both end portions of the bow handle and bow limbs so as to prevent an archer from vibrations produced in a string at release of an arrow, thereby enhancing a stability of shooting.

10 Claims, 10 Drawing Sheets

LIGHT AND DURABLE BOW HAVING BOW HANDLE PRODUCED FROM FORGED ALUMINUM AND PROCESS OF PRODUCING THE BOW HANDLE

FIELD OF THE INVENTION

This invention relates to a bow for shooting an arrow and, more particularly, to a bow having a bow handle produced from forged aluminum and a process of producing the bow handle.

DESCRIPTION OF THE RELATED ART

A bow largely comprises a bow handle, bow limbs attached to both ends of the bow handle and a string stretched between bow nocks of the bow limbs. A take-down type bow has the bow limbs detachable from the bow handle, and, accordingly, a pair of connectors is installed in the bow handle. In the following description, term "string side" means a position closer to a bow string stretched over a bow than a position referred to as "target side".

FIG. 1 illustrates a half of the prior art bow where a bow limb 1 is assembled with a bow handle 2, and a limb balance regulator 3, a locator 4 and a stabilizer 5 is attached to the bow handle 2. The bow handle 2 is formed of light metal such as magnesium alloy, and a pair of hollow spaces 2*a* is formed in both end portions of the bow handle 2. Description is focused on the connection between the bow handle 2 and one of the bow limbs 1.

The bow limb 1 has a boss portion 1*a* on the opposite side of bow nock (not shown), and the boss portion 1*a* is inserted into the hollow space 2*a* as shown. A threaded through-hole 2*b* is formed in the bow handle 2, and is open to the hollow space 2*a*.

A relatively short facing member 1*b* and a relatively long facing member 1*c* are attached to an outer surface of the bow limb 1 on the target side and an inner surface of the bow limb 1 on the target side, respectively. A through-hole 1*d* is formed in the facing members 1*b*/1*c* and the boss portion 1*a* of the bow limb 1, and a hole 1*e* is further formed in the facing member 1*c* and the boss portion 1*a* of the bow limb 1. The hole 1*e* is spaced from the through-hole 1*d*, and is closer to the bow nock than the through-hole 1*d*.

The locator 4 and the limb balance regulator 3 fix the bow limb 1 to the bow handle 2 together with string (not shown) stretched between the bow nocks of the bow limbs 1 as follows.

A pin member 4*a*, a block member 4*b*, a case member 4*f*, a pin member 4*h*, a recess 4*g* and a head portion 4*i* as a whole constitute the locator 4.

The pin member 4*a* is implanted into the hole 1*e*, and the head portion 4*c* projects from the hole 1*e*. The block member 4*b* is attached to the bow handle 2 by means of a screw bolt 4*d*, and a recess 4*e* is formed in the block member 4*b*. The recess 4*e* receives the head portion 4*c*, and the bow limb 1 is appropriately located with respect to the bow handle 2 by inserting the head portion 4*c* into the recess 4*e*.

The case member 4*f* is inserted into the through-hole 1*d* of the boss portion 1*a*, and the pin member 4*h* is housed in the case member 4*f*. The pin member 4*h* is urged toward the outside of the case member 4*f* at all times, and is pressed against the inner surface defining the recess 4*g*. The head portion 4*i* is attached to the case member 4*f* on the opposite side to the pin member 4*h*, and the back surface of the head portion 4*i* is held in contact with the facing sheet member 1*b*.

The limb balance regulator 3 is engaged with the threaded through-hole 2*b* of the bow handle 2, and has a lock cap member 3*m*. The outer surface of the lock cap member 3*m* is partially threaded so as to be screwed into the threaded through-hole 2*b*. A through-hole is formed in the lock cap member 3*m*, and is partially enlarged in diameter. A coil spring 3*n* is received there. The through-hole with the large diameter is plugged with an adjusting screw 3*o* formed of metal, and a hexagon hole 3*oa* is formed in the adjusting screw 3*o*.

A suitable tool (not shown) such as a driver is inserted into the hexagon hole 3*oa*, and rotates the adjusting screw 3*o* so as to change the position in the lock cap member 3*m*. The coil spring 3*n* urges the adjusting screw 3*o* at all times, and does not allow the adjusting screw 3*o* to be unintentionally loosened. When a player wants to change the balance of the bow in his hand, he rotates the adjusting screw 3*o* with a suitable tool, and changes the contact position between the contact member 3*p* and the head portion 3*r*. A contact member 3*p* is received in the adjusting screw 3*o*, and is held in contact with the head portion 4*i*.

The pin member 4*h* urges the head portion 4*i* toward the contact member 3*p*, and the limb balance regulator 3 and the locator 4 maintain the bow limb 1 at an appropriate position in the hollow space 2*a*. The through-hole with the small diameter is threaded, and a bolt 5*a* of the stabilizer 5 is screwed thereinto.

The bow handle 2 is produced by using a die casting. First, a suitable die and magnesium alloy are prepared. The magnesium alloy is melted, and the molten magnesium alloy is injected into the die under high pressure. The molten magnesium alloy is solidified in the die, and the casting product is finished into the bow handle 2.

Another prior art process starts with preparation of an aluminum block, and the aluminum block is directly machined into another prior art aluminum bow handle.

The prior art bow handles encounter a problem in that the archer feels the shooting uncomfortable. When the archer releases an arrow from the prior art bow, the string vibrates, and the vibrations are propagated from the string through the bow limbs 1, the locator 3*j*, the contact member 3*p*, the adjusting screw 3*o* and the lock cap member 3*m* to the bow handle. The archer grips the bow handle 2, and, accordingly, feels the vibrations uncomfortable.

The prior art magnesium bow handle further encounters a problem in the durability. The magnesium alloy is brittle, and is liable to be broken due to a low mechanical strength. The magnesium alloy is fatigued due to repetition of stress, and the prior art magnesium bow handle is liable to be suddenly broken. Especially, the prior art magnesium bow handle is produced through the die casting, and blowholes, a cold shut and segregation make the prior art magnesium bow handle brittle. If the prior art magnesium bow handle is broken during a drawing, the broken pieces hit an archer, and the archer gets hurt. Thus, the magnesium bow handle is dangerous.

The prior art aluminum bow handle is stronger than the prior art magnesium alloy bow handle, and is less liable to be broken. However, the prior art aluminum bow handle is too heavy to be used by a woman archer.

SUMMARY OF THE INVENTION

It is therefore an important object of the present invention to provide a light durable bow which provides a good aftertaste to an archer.

It is also an important object of the present invention to provide a process of producing a light durable bow handle.

To accomplish the first object, the present invention proposes to attenuate vibrations between bow limbs and a bow handle.

To accomplish the second object, the present invention proposes to machine a forged aluminum block into a bow handle.

In accordance with one aspect of the present invention, there is provided a bow for shooting a target with an arrow, comprising: a bow handle formed of light metal, and having slots at both end portions thereof; bow limbs having boss portions respectively inserted into the slots; a string stretched between leading end portions of the bow limbs; and vibration attenuators attached to the both end portions of the bow handle, and absorbing vibrations propagated from the strings through the bow limbs thereto so as to prevent the bow handle from the vibrations.

In accordance with another aspect of the present invention, there is provided a bow for shooting a target with an arrow, comprising: a bow handle formed of forged aluminum alloy, and having end portions on both sides thereof; bow limbs having boss portions respectively connected to the end portions of the bow handle; and a string stretched between leading end portions of the bow limbs.

In accordance with yet another aspect of the present invention, there is provided a process of producing a bow, comprising the steps of: a) preparing a piece of aluminum alloy; b) forging the piece of aluminum alloy for shaping the piece of aluminum alloy into a first intermediate product of a first configuration; c) forming a plurality of windows and slots in the first intermediate product so as to decrease the weight of a second intermediate product; and d) finishing the second intermediate product by using surface treating techniques so as to obtain a bow handle of the bow.

BRIEF DESCRIPTION OF THE DRAWINGS

The features and advantages of the bow and the process of fabricating thereof according to the present invention will be more clearly understood from the following description taken in conjunction with the accompanying drawings in which.

DESCRIPTION OF THE PREFERRED EMBODIMENTS

First Embodiment

Figure 1:
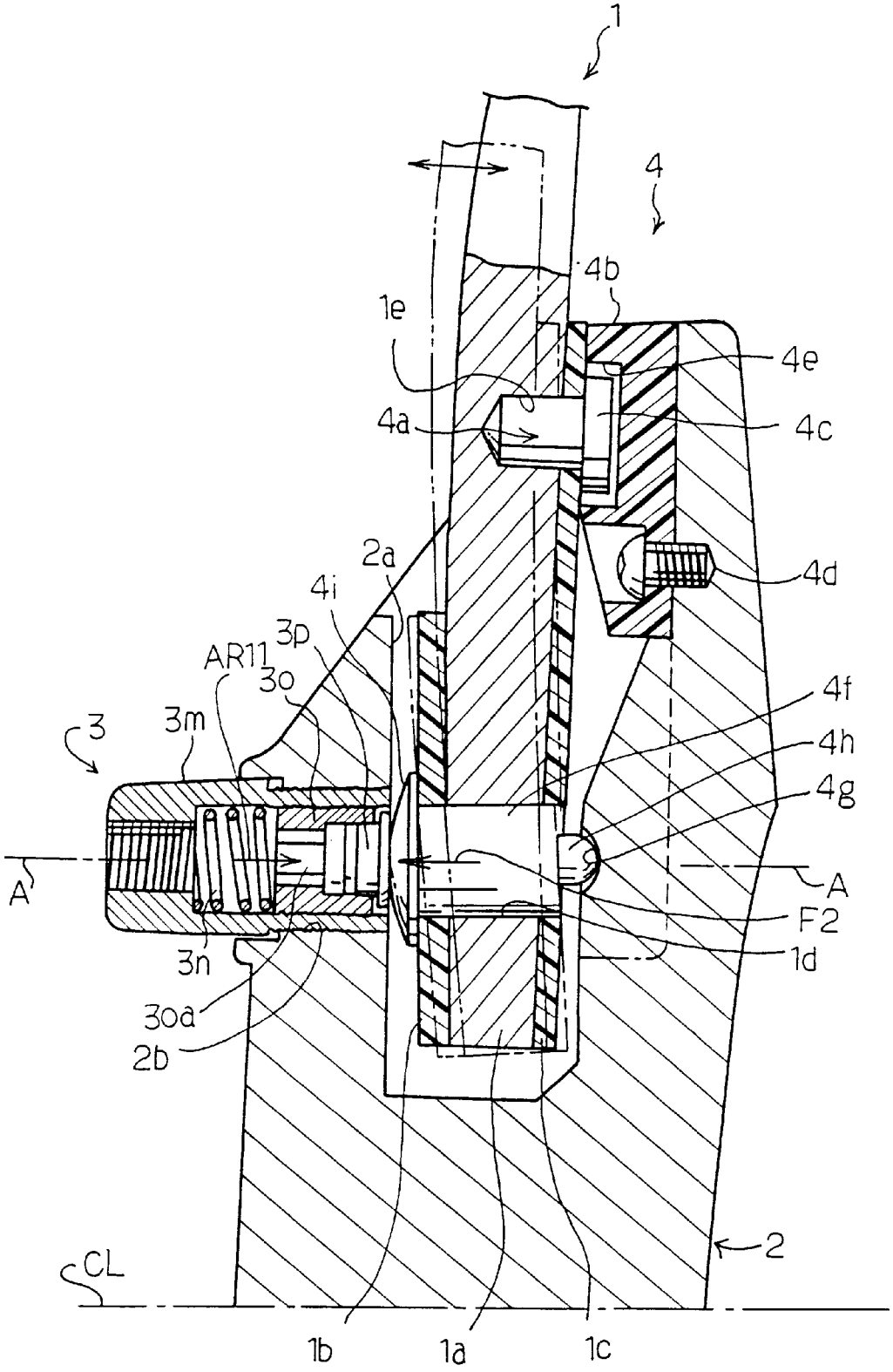
Fig. 1 PRIOR ART
FIG. 1 is a cross sectional view showing the half of the prior art bow.
Figure 2:
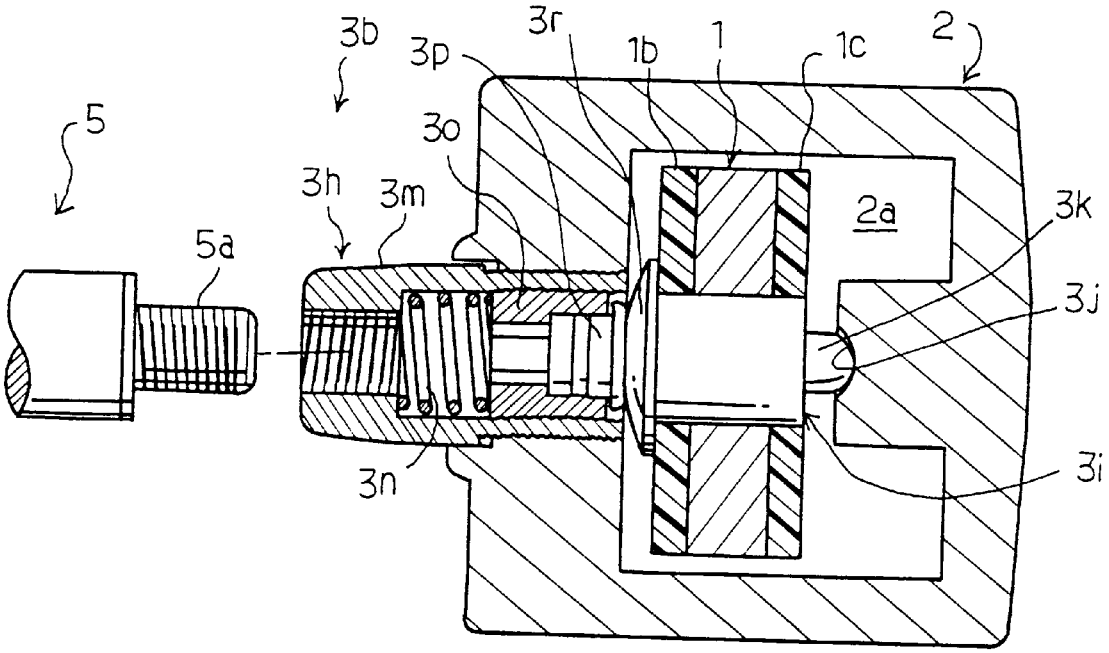
Fig. 2 PRIOR ART
FIG. 2 is a cross sectional view taken along line A—A of FIG. 1 and showing the connector incorporated in the prior art bow.
Figure 3:
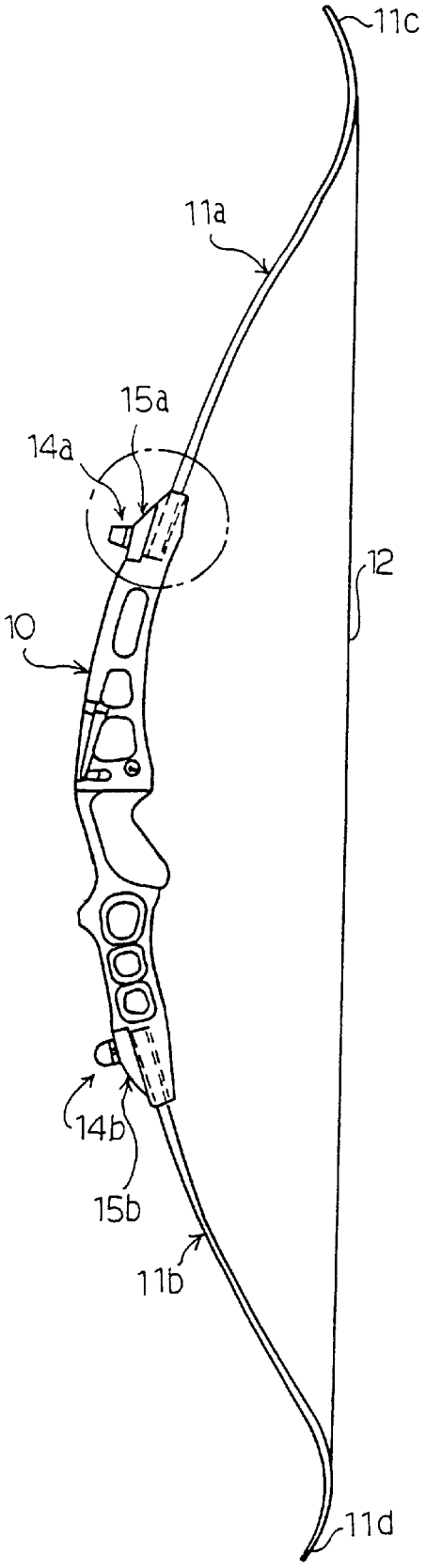
FIG. 3 is a side view showing a bow according to the present invention.
Figure 4:
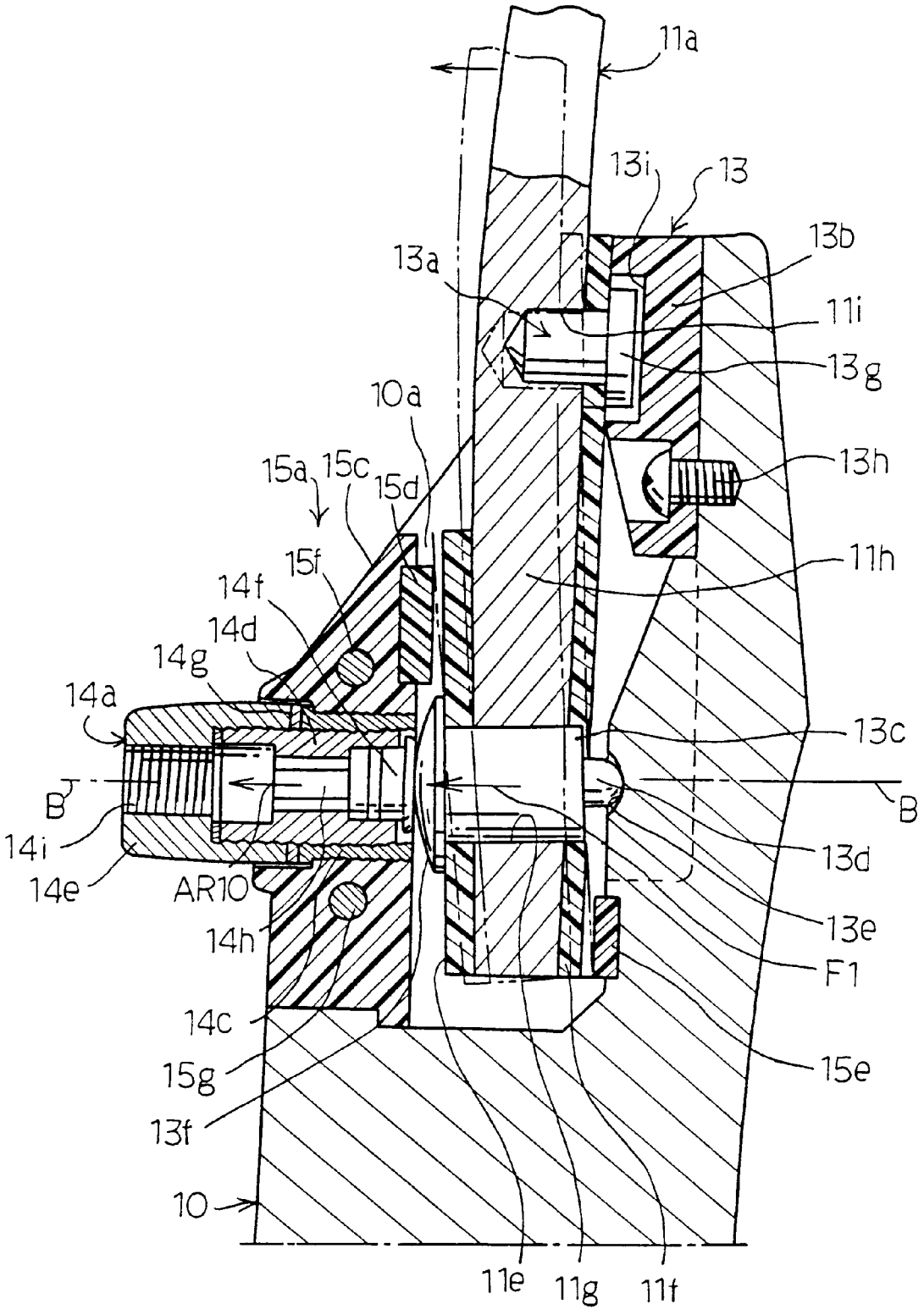
FIG. 4 is a cross sectional view showing a part of a bow handle encircled by dot-and-dash line in FIG. 3.
Figure 5:
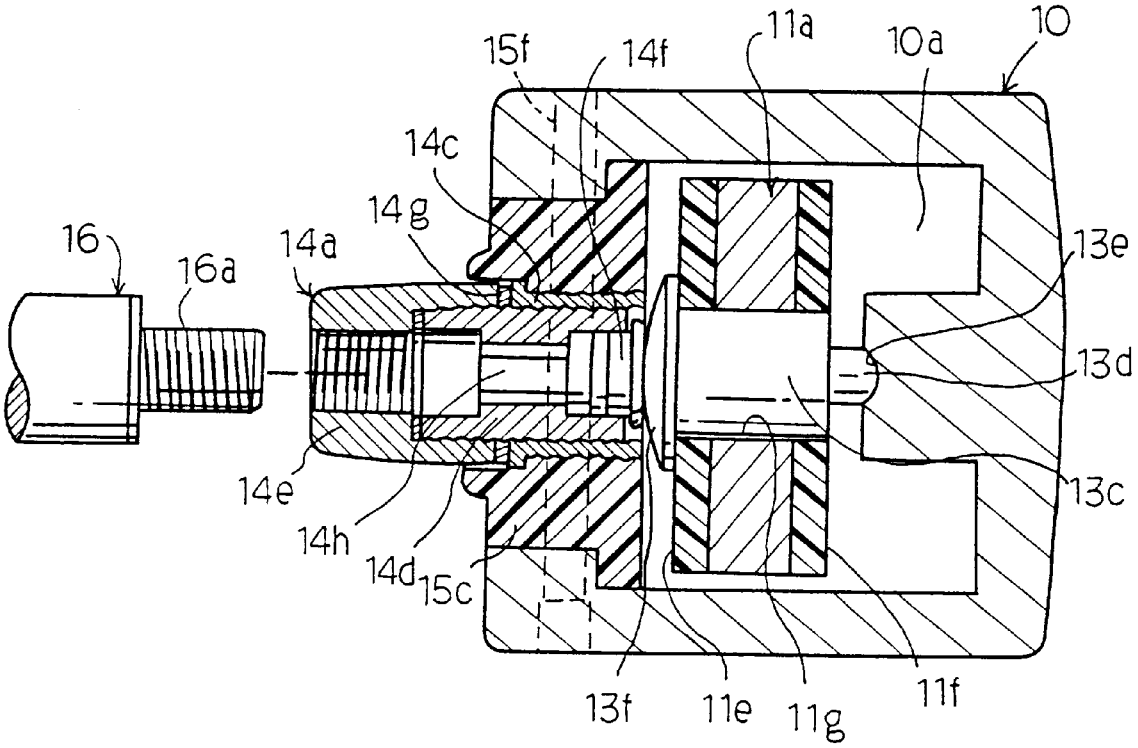
FIG. 5 is a cross sectional view taken along line B—B of FIG. 4 and showing a vibration attenuating member attached to the bow handle.

Referring first to FIGS. 3 to 5 of the drawings, a take-down type bow embodying the present invention largely comprises a bow handle 10, a pair of bow limbs 11*a*/11*b*, a bow string 12 stretched between bow nocks 11*c*/11*d*, a pair of locators 13, a pair of limb balance regulators 14*a*/14*b*, a pair of vibration attenuators 15*a*/15*b* and a stabilizer 16. The bow handle 10 is formed of light metal such as, for example, aluminum alloy or magnesium alloy, and box-shaped hollow spaces 10*a* are formed in both side portions thereof. The bow limbs 11*a*/11*b* are inserted into the box-shaped hollow spaces 10*a*, and are fixed to the bow handle 10 by means of the pair of locators 13 and the pair of limb balance regulators 14*a*/14*b* together with the string 12.

In this instance, the pair of limb balance regulator 14*a*/14*b* is directly attached to the pair of vibration attenuators 15*a*/15*b*, and the pair of vibration attenuators 15*a*/15*b* is fixed to the bow handle 10. The vibration attenuators 15*a*/15*b* are provided between the bow limbs 11*a*/11*b* and the bow handle 10, and decay the vibrations propagated from the bow limbs 11*a*/11*b*. For this reason, an archer feels the aftertaste soft or mild, and the hit ratio is surely enhanced. Moreover, the prevention of vibrations causes the light metal to be less fatigued, and improves the durability of the bow handle 10. The manufacturer is allowed to decrease the mechanical strength of the bow handle 10, and makes the bow light.

The bow limb 11*a*, the locator 13 associated with the bow limb 11*a*, the limb balance regulator 14*a* and the vibration attenuator 15*a* are analogous to the other bow limb 11*b*, the locator associated with the bow limb 11*b*, the limb balance regulator 14*b* and the vibration attenuator 15*b*, respectively, and, for this reason, description is hereinbelow focused on the bow limb 11*a*, the locator 13, the limb balance regulator 14*a*, the vibration attenuator 15*a* and a half of the bow handle 10.

A relatively short facing member 11*e* and a relatively long facing member 11*f* are attached to an outer surface of the bow limb 11*a* on the target side and an inner surface of the bow limb 11*a* on the target side, respectively. A through-hole 11*g* is formed in the facing members 11*e*/11*f* and the boss portion 11*h* of the bow limb 11*a*, and a hole 11*i* is further formed in the facing member 11*f* and the boss portion 11*h* of the bow limb 11*a*. The hole 11*i* is spaced from the through-hole 11*g*, and is closer to the bow nock than the through-hole 11*g*.

A pin member 13*a*, a block member 13*b*, a case member 13*c*, a pin member 13*d*, a recess 13*e* and a head portion 13*f* as a whole constitute the locator 13 associated with the bow limb 11*a*.

The pin member 13*a* is implanted into the hole 11*i*, and the head portion 13*g* projects from the hole 11*i*. The block member 13*b* is attached to the bow handle 10 by means of a screw bolt 13*h*, and a recess 13*i* is formed in the block member 13*b*. The recess 13*i* receives the head portion 13*g*, and the bow limb 11*a* is appropriately located with respect to the bow handle 10 by inserting the head portion 13*g* into the recess 13*i*.

The case member 13*c* is snugly inserted into the through-hole 11*g* of the boss portion 11*h*, and the pin member 13*d* is housed in the case member 13*c*. Though not shown in the drawings, a spring member resiliently urges the pin member 13*d* toward the outside of the case member 13*c* at all times, and the pin member 13*d* is pressed against the inner surface defining the recess 13*e*. The head portion 13*f* is attached to the case member 13*c* on the opposite side to the pin member 13*d*, and the back surface of the head portion 13*f* is held in contact with the facing sheet member 11*f*.

The vibration attenuator 15*a* includes an attenuation block 15*c* and cushion members 15*d*/15*e*. The attenuation block 15*c* is formed of a fiber-reinforced thermoplastic synthetic resin such as, for example, polyamide reinforced with carbon fibers or polycarbonate reinforced with carbon fibers, and is fixed to the bow handle 10 by means of rivets 15*f*/15*g*. The attenuation block 15*c* may be fixed to the bow handle 10 by means of a pin, a key or a screw bolt. Thermoplastic synthetic resin called as "×6 nylon" is available for the fiber-reinforced thermoplastic synthetic resin. The ×6 nylon is three times larger in vibration attenuating characteristics than epoxy resin and six-hundred times larger than aluminum. Thus, the fiber-reinforced thermoplastic resin has large vibration attenuating characteristics, and effectively blocks the bow handle 10 from the vibrations produced at a release of an arrow.

The cushion member 15*d* is attached to the attenuation block 15*c*, and is opposed to the facing sheet member 11*e*. The other cushion member 15*e* is attached to the bow handle 10, and is opposed to the facing sheet member 11*f*. The cushion members 15*d*/15*e* are formed of thermoplastic synthetic resin. When the bow string 12 is stretched between the bow nocks 11*c*/11*d*, the bow string 12 urges the bow limb 11*a* toward the string side. When the bow string 12 is undesirably cut, the bow limb 11*a* recoils as indicated by dots-and-dash line in FIG. 4, and the facing sheet members 11*e* and 11*f* violently impact the cushion members 15*d*/15*e*, respectively. The cushion members 15*d*/15*e* weaken the impact of the bow limb 11*a*, and prevent the bow limb 11*a* from jump-out from the box-shaped hollow space 10*a*.

If the facing sheet members directly impact the inner surfaces of the bow handle of the light metal as the prior art bow, the bow limb 11*a* jumps out of the box-shaped hollow space, and the archer would get hurt. Thus, the cushion members 15*d*/15*e* enhance the safety during a shooting.

The limb balance regulator 14*a* includes a sleeve member 14*c*, an adjusting bolt 14*d*, a lock cap member 14*e*, a contact member 14*f* and a packing member 14*g*.

The sleeve member 14*c* has a threaded inner surface and a threaded outer surface, and the threaded outer surface of the sleeve member 14*c* is screwed into a threaded through-hole formed in the attenuation block 15*c*. The threaded through-hole is open to the box-shaped hollow space 10*a*, and, accordingly, the inner end of the sleeve member 14*c* is exposed to the box-shaped hollow space 10*a*.

The adjusting bolt 14*d* has an H-letter like cross section, and a hexagonal hole 14*h* is formed in the adjusting bolt 14*d*. Holes are formed in the adjusting bolt 14*d* on both sides of the hexagonal hole 14*h*, and are larger in diameter than the diagonal line of the hexagonal hole 14*h*. The inner surface defining one of the holes is threaded, and the outer surface of the adjusting bolt 14*d* is also threaded. The threaded outer surface of the adjusting bolt 14*d* is screwed into the inner threaded surface of the sleeve member 14*c*, and the relative position between the sleeve member 14*c* and the adjusting bolt 14*d* is regulable.

The contact member 14*f* is screwed into one of the holes formed in the adjusting bolt 14*d*, and the relative position between the contact member 14*f* and the sleeve member 14*c* is changeable.

The lock cap member 14*e* has a recess and a threaded hole 14*i* open to the recess. The inner surface defining the recess is threaded, and the outer threaded surface of the adjusting bolt 14*d* is screwed into the inner threaded surface defining the recess in the lock cap member 14*e*. While the lock cap member 14*e* is being rotated so as to be brought into threaded engagement with the adjusting bolt 14*d*, the adjusting bolt 14*d* is forced in a direction indicated by an arrow AR10. The force F1 exerted on the contact member 14*f* urges the contact member 14*f* in the same direction as AR10, and, for this reason, the adjusting bolt 14*d* is hardly loosened with respect to the sleeve member 14*c*. A bolt 16*a* of the stabilizer 16 is screwed into the threaded through-hole 14*i* of the lock cap member 14*e*. The bolt 16*a* is projectable into the hole of the adjusting bolt 14*d*, and, for this reason, the stabilizer 16 is fastened to the lock cap member 14*e*.

The packing member 14*g* is sandwiched between the sleeve member 14*c* and the lock cap member 14*e*, and the threaded through-hole 14*i* is connected to the other of the holes formed in the adjusting bolt 14*d*. The packing member 14*g* takes up the force exerted on the sleeve member 14*c* which is opposite to the direction AR10, and the packing member 14*g* prevents the adjusting bolt 14*d* from undesirable looseness.

In the prior art limb balance regulator 3, the resilient force AR11 of the coil spring 3*n* is oppositely directed to the force F2 exerted on the contact member 3*p*, and the resilient force is partially canceled. On the other hand, the force F2 is directed in the same direction as AR10 in the limb balance regulator 14*a*, and the limb balance regulator 14*a* strictly maintains the limb balance.

When an archer wants to change the balance of the bow, he inserts a suitable tool such as a driver or a hexagonal wrench into the hexagonal hole 14*h*, and rotates the adjusting blot 14*d* so as to change the relative position between the sleeve member 14*c* and the adjusting bolt 14*d* and, accordingly, the relative position between the contact member 14*f* and the attenuation block 15*c*. In this way, the archer projects the contact member 14*f* from the attenuation block 15*c* or retracts it into the attenuation block 15*c*, thereby regulating the limb balance.

Assuming now that an archer releases an arrow toward a target, the string 12 imparts kinetic energy to the arrow, and returns to the initial position. However, a remaining energy causes the string 12 to vibrate, and the vibration is propagated from the string 12 to the bow limbs 11*a*/11*b*. The vibrating bow limbs 11*a*/11*b* repeatedly press the head portions 13*f* against the contact members 14*f*, and the contact members 14*f* vibrate. Although the vibrations of the contact members 14*f* are propagated through the adjusting bolts 14*d* and the sleeve members 14*c* to the attenuation block 15*c*, the attenuation block 15*c* takes up the vibrations, and only a negligible amount of the vibrations is transferred to the bow handle 10. For this reason, the archer feels the bow stable and comfortable.

As will be appreciated from the foregoing description, the bow according to the present invention provides a soft aftertaste to an archer, and the stable bow enhances the hit ratio. The bow is light and durable, because the light metal is less fatigued by the vibrations.

Second Embodiment

Figure 6:
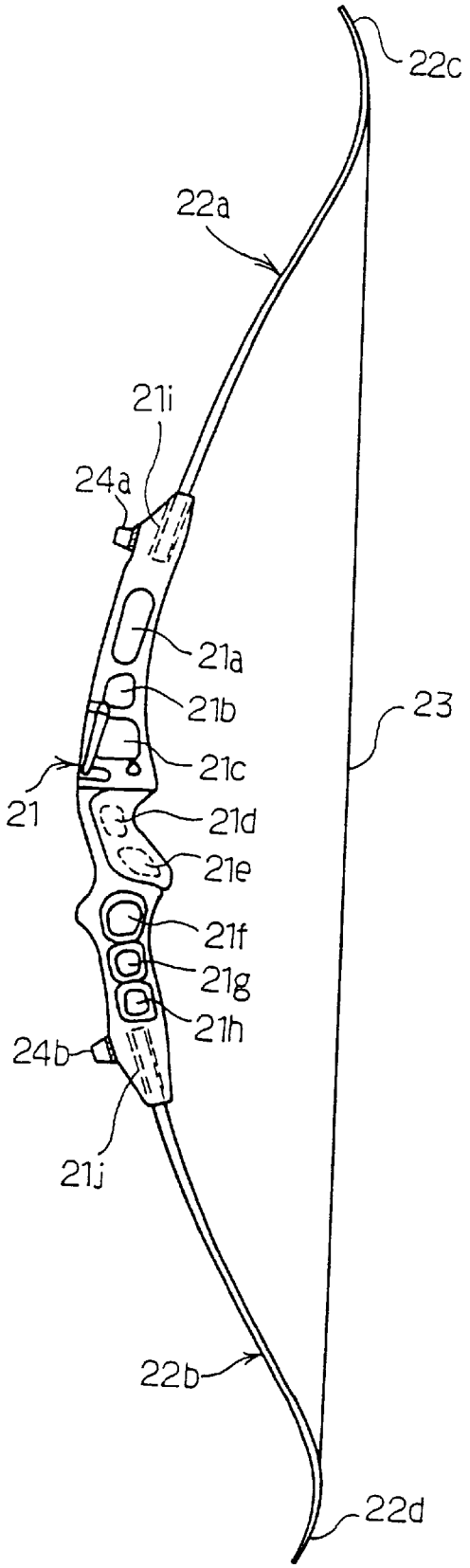
FIG. 6 is a side view showing another bow according to the present invention.

FIG. 6 illustrates another bow embodying the present invention. The bow is categorized into the take-down type, and largely comprises a bow handle 22, a pair of bow limbs 22*a*/22*b*, a string 23 stretched between bow nocks 22*c*/22*d* of the bow limbs 22*a*/22*b*, a pair of locators (not shown in FIG. 6) and a pair of limb balance regulators 24*a*/24*b*.

The bow handle 21 is formed of forged aluminum alloy, and is light and durable, because the forged aluminum alloy has a large tenacity. In this instance, the forged aluminum contains Cu, Mg and Zn, and Cu, Mg and Zn range between  percent and  percent by weight, between  percent and  percent by weight and between  percent and  percent by weight, respectively.

A plurality of windows 21*a*, 21*b*, 21*c*, 21*d*, 21*e*, 21*f*, 21*g* and 21*h* are formed in the bow handle 21 so as to decrease the weight of the bow handle 21. The total area of the windows 21*a* to 21*h* is maximized in so far as the remaining portion of the bow handle 21 withstands a bending moment during a drawing and the vibrations after release of an arrow.

Box-shaped hollow spaces 21*i*/21*j* are formed in both end portions of the bow handle 21, and the boss portions of the bow limbs 22*a*/22*b* are inserted into the box-shaped hollow spaces 21*i*/21*j*, respectively. The limb balance regulators 24*a*/24*b* are similar to the limb balance regulator 3 of the prior art bow, and the locators, which are similar to the locator 4, and the limb balance regulators 24*a*/24*b* maintain an appropriate attitude of the bow limbs 22*a*/22*b* in the box-shaped hollow spaces 21*i*/21*j* together with the string 23 stretched between the bow nocks 22*c* and 22*d*.

Figure 7:
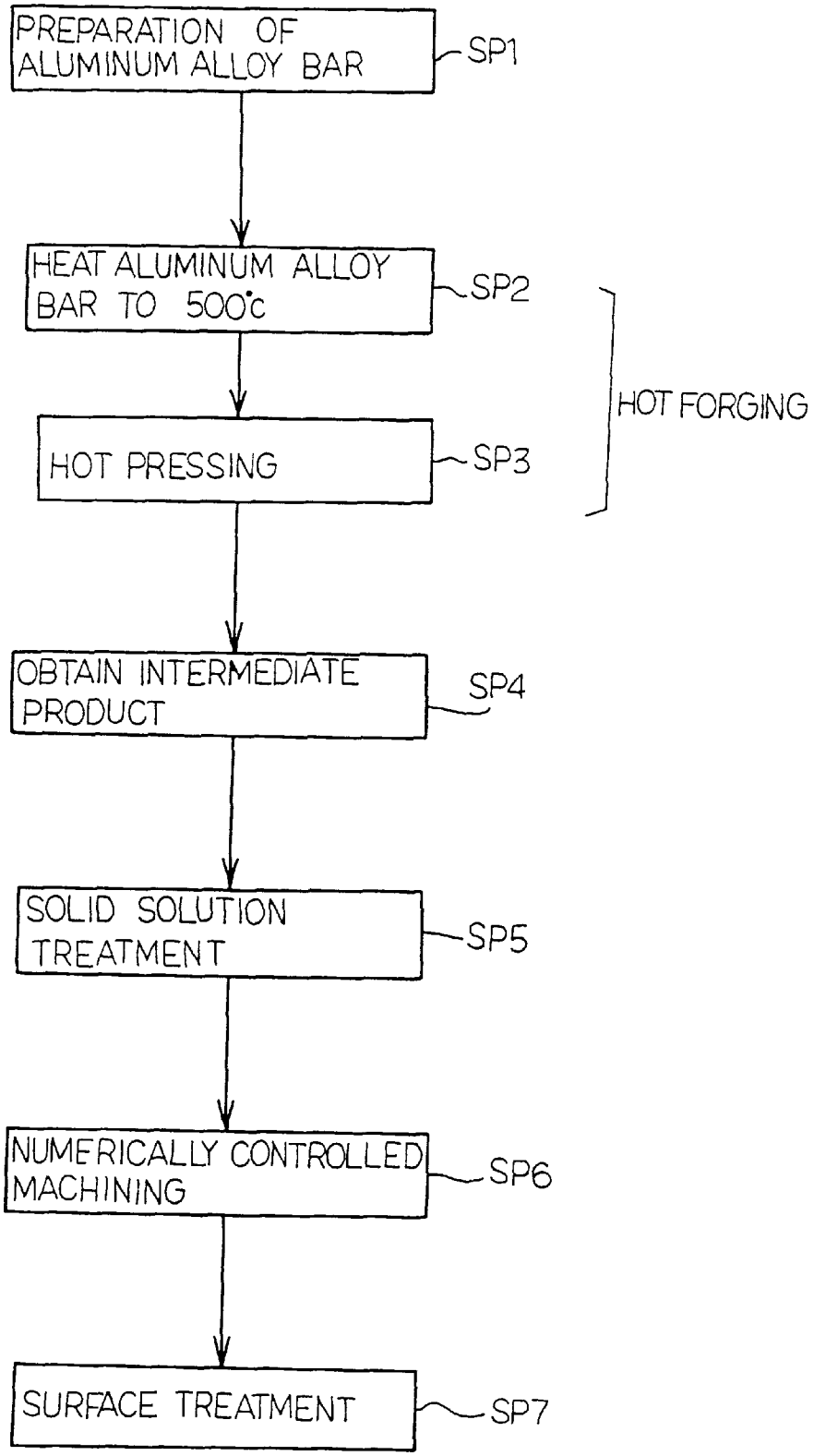
FIG. 7 is a flow chart showing a process of producing a bow handle incorporated in the bow shown in FIG. 6.
Figure 8A:
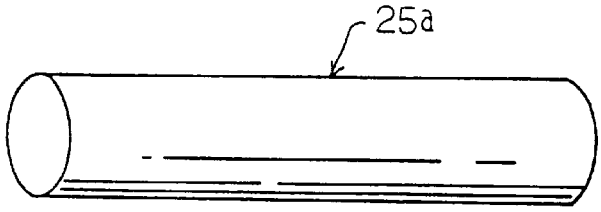
FIG. 8A is a perspective view showing an aluminum alloy bar.

Subsequently, a process of producing the bow handle 21 is hereinbelow described with reference to FIG. 7. The process starts with preparation of a bar 25*a* of the aluminum alloy (see FIG. 8A) as by step SP1. The aluminum alloy bar 25*a* is 48 millimeter in diameter and 600 millimeter in length.

Figure 8B:
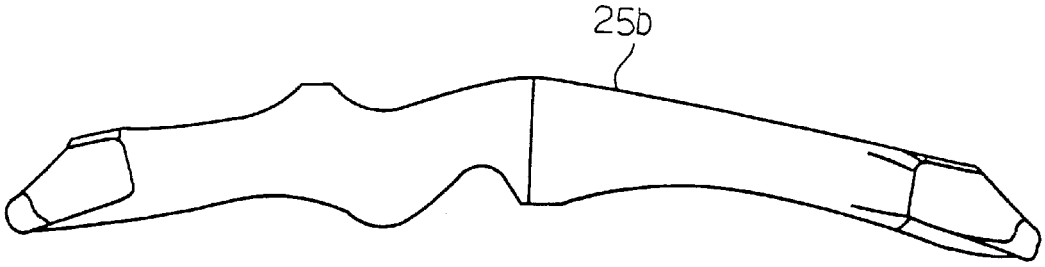
FIG. 8B is a front view showing an intermediate product shaped through a hot forging.
Figure 8C:
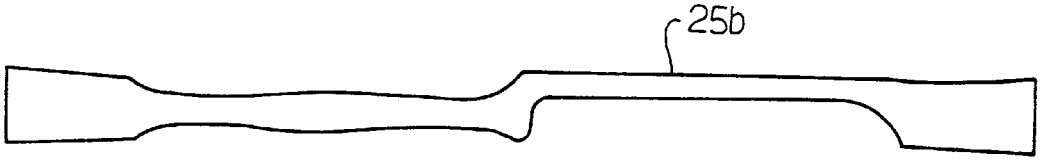
FIG. 8C is a plan view showing the intermediate product.

The aluminum alloy bar 25*a* is heated to 450 degrees in centigrade, and is placed between forging dies (not shown). A forging machine (not shown) presses the forging dies to the aluminum alloy bar 25*a* with 3300 tons, and finishes an intermediate product by pressing the forging dies against it about 3300 tons per square centimeter as by step SP3. Thus, the aluminum alloy bar 25*a* is shaped into an intermediate product 25*b* shown in FIGS. 8B and 8C at step SP4, and three-dimensional curved surface form a part of the configuration of the intermediate product 25*b*.

Subsequently, the intermediate product 25*b* is heated to 530 degrees in centigrade, and is maintained for three hours. The temperature is decreased from 530 degrees in centigrade to 180 degrees in centigrade, and the intermediate product 25*b* is maintained for six hours. Thus, the intermediate product 25*b* is subjected to a solid solution treatment as by step SP5.

Figure 8D:
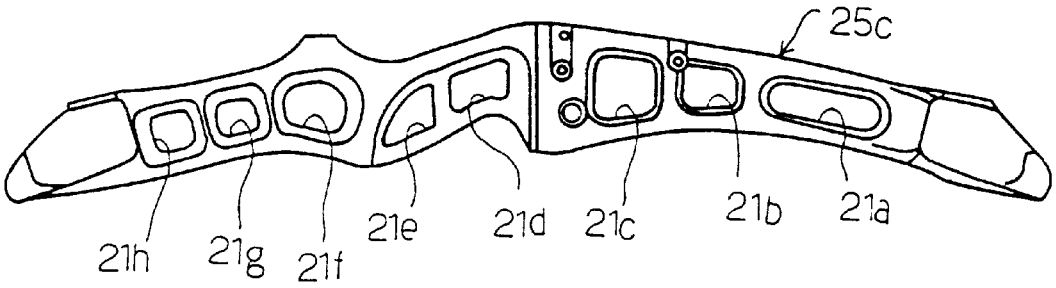
FIG. 8D is a front view showing an intermediate product shaped by a numerically controlled machine.

Thereafter, the windows 21*a* to 21*h* and the box-shaped hollow spaces 21*i*/21*j* are formed in the intermediate product through numerical controlled machinings as by step SP6, and the intermediate product 25*b* is formed into an intermediate product 25*c* shown in FIG. 8D.

Figure 8E:
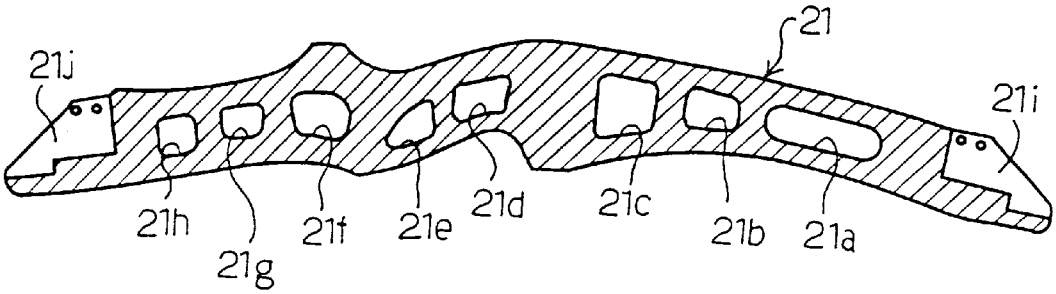
FIG. 8E is a cross sectional view showing the bow handle after a surface finishing.

Finally, the surface of the intermediate product 25*c* is grinded, and is coated with paint as by step SP7. Thus, the bow handle 21 is obtained through a surface finishing, and FIG. 8E illustrates a cross section of the bow handle 21.

The forging achieves a high dense crystal organization, and the forged aluminum alloy has a large tenacity. Moreover, the numerically controlled machinings precisely shape the intermediate product 25 into a target configuration. As a result, the bow handle 21 is light and durable, and the large tenacity prevents the bow handle 21 from sudden breakage. Additionally, the aluminum alloy is free from undesirable dust explosion, and is easily machined.

Third Embodiment

Figure 9:
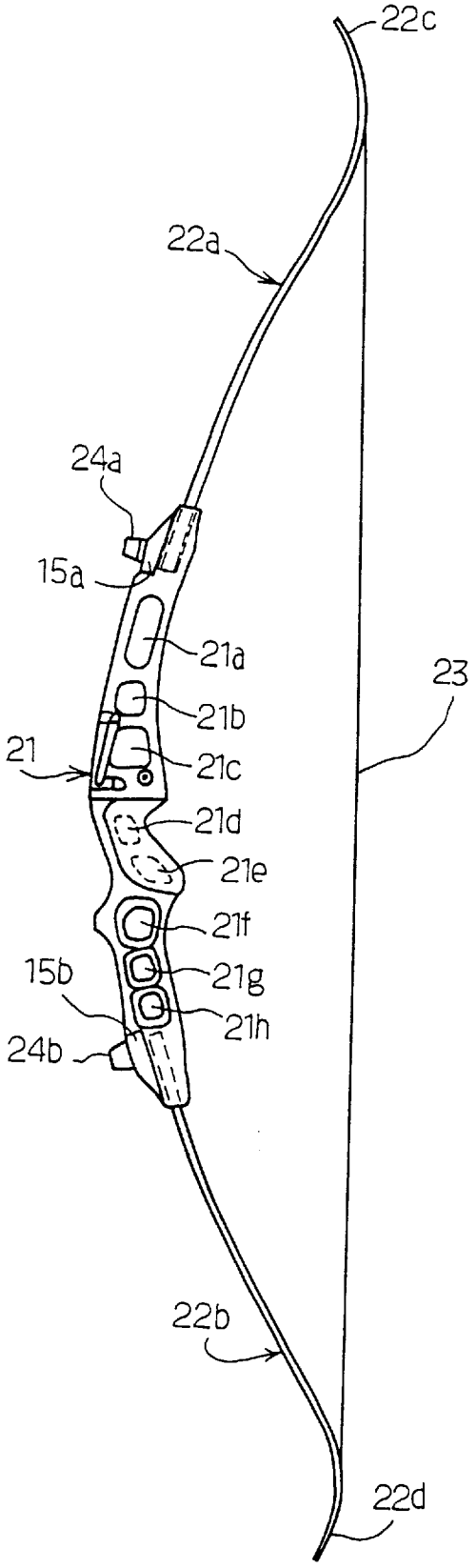
FIG. 9 is a side view showing yet another bow according to the present invention.

FIG. 9 illustrates yet another take-down type bow embodying the present invention. The third embodiment is a compromise between the first embodiment and the second embodiment. Namely, the bow implementing the third embodiment further has a pair of vibration attenuators 15*a* and 15*b*, and the vibration attenuators 15*a*/15*b* are similar to that of the first embodiment. The bow handle 21 is formed of the forged aluminum alloy, and has the same configuration as the bow handle 10. The pair of locators 13 and the limb balance regulators 14*a*/14*b* locates the bow limbs 22*a*/22*b* in the box-shaped hollow spaces together with the strings 23 stretched between the bow nocks 22*c*/22*d*. For this reason, the component members of the third embodiment are labeled with the same references as those designating corresponding parts of the first and second embodiments.

The vibration attenuators 15*a*/15*b* allow the manufacturer to further decrease the mechanical strength of the bow handle 21 and, accordingly, the weight thereof, because the forged aluminum alloy is less fatigued by the vibrations. In fact, the weight the bow handle equipped with the vibration attenuators 15*a*/15*b* is of the order of 1.1 kilo-grams, and a woman archer can easily draw the bow.

The bow implementing the third embodiment achieves all the advantages of first and second embodiments.

Although particular embodiments of the present invention have been shown and described, it will be obvious to those skilled in the art that various changes and modifications may be made without departing from the spirit and scope of the present invention.

For example, the sleeve members 14*c* may be fixed to the attenuation blocks 15*c* by means of adhesive compound, pins or other fasting means.

The bow handle formed from the forged aluminum alloy is not limited to the take-down type bow.

What is claimed is:

1. A bow for shooting a target with an arrow, comprising:

a bow handle formed of light metal, and having slots at both end portions thereof;

bow limbs having boss portions respectively inserted into said slots;

a string stretched between leading end portions of said bow limbs; and vibration attenuators attached to said both end portions of said bow handle, and absorbing vibrations propagated from said string through said bow limbs thereto so as to prevent said bow handle from said vibrations.

2. The bow as set forth in claim 1, in which said vibration attenuators have respective attenuation blocks attached to said both end portions of said bow handle in such a manner as to partially define said slots, respectively, and formed of fiber-reinforced thermoplastic synthetic resin.

3. The bow as set forth in claim 2, in which said vibration attenuators further have first cushion members attached to said attenuation blocks in such a manner as to be opposed to first surfaces of said bow limbs, respectively, and second cushion members attached to inner surfaces of said both end portions partially define said slots in such a manner as to be opposed to second surfaces of said bow limbs opposite to said first surfaces thereof.

4. The bow as set forth in claim 2, further comprising limb balance regulators respectively supported by said attenuation blocks and having movable contact surfaces exposed to said slots for receiving elastic forces of said bow limbs, respectively.

5. The bow as set forth in claim 4, in which each of said limb balance regulators has a sleeve member fixed to an inner surface of associated one of said attenuation block defining a through-hole connected to one of said slots and having an inner threaded portion, an adjusting bolt having an outer threaded portion screwed into said inner threaded portion of said sleeve member in a regulable manner and a hole for receiving a contact member providing one of said contact surfaces, a lock cap member having an inner threaded portion engaged with said outer threaded portion of said adjusting bolt, and pulling said adjusting bolt in a same direction as one of said elastic forces exerted on said one of said contact surfaces, and a cushion member inserted between said adjusting bolt and said lock cap member.

6. A bow for shooting a target with an arrow, comprising:

a bow handle formed of forged aluminum alloy, and having end portions on both sides thereof;

bow limbs having boss portions respectively connected to said end potions of said bow handle;

a string stretched between leading end portions of said bow limbs; and vibration attenuators attached to said both end portions of said bow handle and absorbing vibrations propagated from said strings through said bow limbs thereto so as to prevent said bow handle from said vibrations.

7. The bow as set forth in claim 6, in which said both end portions of said bow handle have respective slots where said boss portions of said bow limbs are inserted, and said vibration attenuators have respective attenuation blocks attached to said both end portions of said bow handle in such a manner as to partially define said slots, respectively, and formed of fiber-reinforced thermoplastic synthetic resin.

8. The bow as set forth in claim 7, in which said vibration attenuators further have first cushion members attached to said attenuation blocks in such a manner as to be opposed to first surfaces of said bow limbs, respectively, and second cushion members attached to inner surfaces of said both end portions partially define said slots in such a manner as to be opposed to second surfaces of said bow limbs opposite to said first surfaces thereof.

9. The bow as set forth in claim 7, further comprising limb balance regulators respectively supported by said attenuation blocks and having movable contact surfaces exposed to said slots for receiving elastic forces of said bow limbs, respectively.

10. The bow as set forth in claim 9, in which each of said limb balance regulators has a sleeve member fixed to an inner surface of associated one of said attenuation block defining a through-hole connected to one of said slots and having an inner threaded portion, an adjusting bolt having an outer threaded portion screwed into said inner threaded portion of said sleeve member in a regulable manner and a hole for receiving a contact member providing one of said contact surfaces, a lock cap member having an inner threaded portion engaged with said outer threaded portion of said adjusting bolt, and pulling said adjusting bolt in a same direction as one of said elastic forces exerted on said one of said contact surfaces, and a cushion member inserted between said adjusting bolt and said lock cap member.

* * * * *